United States Patent [19]

Trent et al.

[11] 4,348,133

[45] Sep. 7, 1982

[54] MEDIAN BARRIER CONSTRUCTION

[75] Inventors: Peter F. Trent, Westmount; Raymond Charlebois, Laval sur-le-Lac, both of Canada

[73] Assignee: Plastibeton Canada Inc., Canada

[21] Appl. No.: 155,596

[22] Filed: Jun. 2, 1980

[30] Foreign Application Priority Data

Apr. 25, 1980 [CA] Canada ..... 350738

[51] Int. Cl.[3] ..... E01F 13/00; E01F 15/00; E01C 11/22

[52] U.S. Cl. ..... 404/6; 256/13.1; 52/309.17; 404/73

[58] Field of Search ..... 404/73, 6, 7, 13; 52/174, 309.15, 309.17; 256/13.1

[56] References Cited

U.S. PATENT DOCUMENTS

| | | | |
|---|---|---|---|
| 105,599 | 7/1870 | Schillinger | 404/47 |
| 1,017,346 | 2/1912 | Thomas | 404/47 |
| 1,606,189 | 12/1925 | Shaffer | 404/47 |
| 2,108,750 | 2/1938 | Isett | 404/6 |
| 2,296,352 | 9/1942 | Keller . | |
| 2,532,524 | 12/1950 | Walker . | |
| 3,540,699 | 11/1970 | Guzzardella | 256/13.1 |
| 3,678,815 | 7/1972 | Younker | 256/13.1 |
| 3,983,956 | 10/1976 | Manhart | 256/13.1 |
| 4,113,400 | 9/1978 | Smith | 256/13.1 |

FOREIGN PATENT DOCUMENTS

| | | | |
|---|---|---|---|
| 651115 | 10/1962 | Canada | 404/7 |
| 2106656 | 9/1971 | Fed. Rep. of Germany | 256/13.1 |
| 2705842 | 1/1977 | Fed. Rep. of Germany | 52/309.15 |
| 776756 | 2/1935 | France | 404/13 |
| 1349211 | 12/1963 | France | 404/7 |
| 2221950 | 10/1974 | France | 404/7 |
| 7704368 | 10/1977 | Netherlands | 404/7 |
| 1497860 | 1/1978 | United Kingdom | 256/13.1 |
| 1538064 | 1/1979 | United Kingdom | 404/7 |

OTHER PUBLICATIONS

Status of Concrete-Polymer Composites in the United States and Abroad-Apr. 30, 1973, Public Roads-vol. 37, No. 4, pp. 129 to 135.

*Primary Examiner*—C. J. Husar
*Assistant Examiner*—Roberto L. Calderon
*Attorney, Agent, or Firm*—Roylance, Abrams, Berdo & Farley

[57] ABSTRACT

A highway median barrier construction is disclosed wherein the barrier is formed as integral U-shaped shell sections of polymer concrete which are placed end-to-end at the construction site and are then filled with hydraulic concrete or other ballast through filling holes which are then capped with polymer concrete.

12 Claims, 2 Drawing Figures

MEDIAN BARRIER CONSTRUCTION

This invention relates to median barriers for use in highway construction, and more particularly to a median barrier consisting of a polymer concrete, integrally pre-formed shell which is filled with ballast after the shell has been put into place at the construction site.

Median barriers are provided on roadways for safety and protection of automobiles travelling over them, by providing a division between traffic proceeding in opposite directions. At one time, such median barriers were formed of pre-formed steel bars, wire cables, and similar constructions. However, at present the New Jersey type of concrete median barrier is being required by more and more highway authorities because it is particularly designed for safety by virtue of its shape. Because of its shape, an automobile hitting the barrier tends to be deflected back into the traffic lane from which it came, rather than going over the barrier, or breaking the barrier.

To construct such barriers of solid concrete by casting in forms at the construction site, or forming pre-cast barriers, has a number of disadvantages relating to cost, and particularly in the case of pre-cast solid barriers, high weight which would not allow shipping of any appreciable number of sections. As far as casting in place is concerned, the labour cost is high.

The use of a form which can be filled with ballast, as for example concrete, and the form left in place as part of the final construction, is known for a number of applications. Examples are U.S. Pat. No. 2,296,352 of Keller, which relates to forms used in the construction of concrete piers for building supports. The concrete footing is poured in a hole for the pier, and then a form placed on the footing before the concrete has set. Concrete is then poured into the form. The use of the form permits completion of the structure before the concrete has set, and if the form is left in place it can be anchored.

U.S. Pat. No. 2,532,524 of Walker relates to cemetery lot curbing, which uses an assembly of pre-cast concrete structural parts transported to the site and assembled. The parts are inter-fitting, and consist of connecting units which are hollow, and into which is placed a plastic/cement mixture to fill them, after assembly of the parts. When the cement mix has set, the various parts of the construction are locked into place, as well as caps which are used to cover the openings into which the cement mixture is poured.

Another example is U.S. Pat. No. 3,983,956 of Mannhart, which relates to noise reduction barriers for use with highways. These barriers are constructed along the edges of highways, and consist of three-dimensional panel members made of lightweight structural materials. They are erected in place to form a continuous barrier, and are then filled with inexpensive material which absorbs sound, as for example loose earth or sand.

U.S. Pat. No. 4,113,400 of Smith relates to concrete traffic barriers for highway construction, but does not disclose any details of the construction of the barrier itself; rather, it relates to an improvement in vertical tongue-and-groove arrangements which are integrally moulded at the ends of the barrier to permit connection of barrier sections when these are put into place.

None of the foregoing patents deal with any particular construction of highway median barriers, nor do they relate to the use of any particular type of concrete for pre-cast forms to be later filled at the construction site.

However, U.S. Pat. No. 3,678,815 of Younker deals directly with the construction of highway median barriers. It relates to the use of a pre-cast concrete shell made of white hydraulic concrete which is erected in place and then filled by casting ordinary grey concrete into the shell. The shell is made in sections which are assembled in place, but each shell section is cast in two parts which are erected opposite one another and bolted together at intervals along the section. Each part of the shell section is formed with transversely-extending end pieces to form a solid end to the section when it is assembled, and tie bolts are passed through holes provided in the end pieces. Thus, the shell parts are secured in place. However, the top of the shell sections are left open, so that the form can be filled with cast-in-place concrete at the job site, and the top of the core concrete so formed is left exposed. It is specifically disclosed in the patent that the core concrete must adhere to the shell, so that the section when filled acts as a unitary structure, presumably to withstand freeze-and-thaw conditions.

There are a number of disadvantages to the median barrier structure shown in the Younker patent. One is that the white concrete shell will deteriorate with time by the action of weather and dirt, and also salt which is used on highways under winter conditions in many areas. Also, in the construction shown in the Younker patent the interior core is exposed along the top of the structure. Obviously, in Younker, means are required to secure the section parts together, which means that assembly at the site is complicated and costly, in that erection costs are always calculated on a per item basis. The means disclosed are bolts, the exposed ends of which are to be covered with "white plastic inserts" or "grout", which would be of doubtful permanence, resulting in a source of rust stains. Furthermore, although the end pieces provide stability to the assembled shell sections, the fact that each section requires end pieces means that the pre-casting procedures are complex, and the end pieces on each section add to the weight of the structures which must be transported to the construction site.

Another disadvantage of the median barrier structure of the Younker patent is that the sections cannot be cut to size on site because of the transverse end pieces. It is often necessary to have available short sections of median strips for use between light standards, or bridge expansion joints, or the like. Even when longer sections can be used, it is unlikely that the lengths required will always be even multiples of the median barrier sections cast.

The pre-cast white concrete shell and the cast-in-place grey concrete core will, in practice, be of different quality as to strength and water absorption. Differential expansion between the two elements can occur, and as the patent discloses that the core and the shell must adhere, cracking of the shell can occur.

The most significant disadvantage to the disclosed structure is that the patent nowhere discloses or suggests that the shell sections could be cast in one piece, and in fact this would not be possible with conventional pre-casting methods for hydraulic concrete. To cast a "U-shaped" form in one piece for a median barrier requires vertical casting using a closed mould, and unless this were done using a thick steel-reinforced shell, for example 4 inches, it could not be carried out with hydraulic concrete. The reason is, of course, that hydraulic concrete mix is viscous, that is, it has "low slump", and it could not be poured into a U-shaped vertical mould if the molded shell is to be thin, say of a 2-inch thickness or less, not to mention that the finished casting might not be strong enough to transport. The amount of liquid used in hydraulic concrete is very important in obtaining high-quality material, and it must be the minimum amount possible, unless expensive "super plasticizers" are used. Thus, the viscosity could not be adjusted as required by the mould used. Obviously, thickness of the shell is very important, as the maximum width of a median barrier will only be 2 to 3 feet, and if the U-shaped shell must be 4 inches thick, then the purpose of having a two-part structure as compared to a solid cast barrier is defeated, especially when the median barrier profile has a top less than 20 inches or so across.

It has now been found that shell sections in the desired shape of a median barrier can readily be integrally cast with ensured quality, and can be erected at the highway construction site to be filled with ballast material which does not adhere to the pre-cast shell, thereby overcoming many of the disadvantages of the prior art discussed. By being able to cast the U-shaped shell for the barrier construction as integral sections, the fastening means required in Younker are eliminated, it is not necessary to cast end pieces for each section, and the thickness of the U-shaped shell can be reduced to as low as 1 inch with no loss in strength of the shell. Furthermore, the U-shaped shell has high chemical resistance to deterioration and to change in colour, and as the fill and the shell do not adhere, any differential expansion and contraction can occur without interference from the form, thus minimizing cracking of the shell. Also, the core material is not left exposed along the top of the barrier construction, and thus the fill is not exposed to moisture, chemicals, and the like. It should be particularly noted as well that the shell sections can readily be cut to size as required at the construction site.

The foregoing advantages can be accomplished by casting a U-shaped shell of polymer concrete, which of course is known for its high chemical resistance and strength and other valuable properties. The shell sections are easily transportable, as they can be stacked, and are more easily erected at the construction site. Filling of the shell can be with any ballast material which provides impact resistance, but is preferably of hydraulic concrete which, however, need not be of high quality. Whether ballast material such as gravel or sand is used, or hydraulic concrete, these substances do not adhere to the pre-cast polymer concrete shell.

Thus, in one aspect, the present invention provides a structural member comprising an elongated, relatively thin outer U-shaped shell member integrally pre-formed of polymer concrete, having an outer surface defining an outer peripheral desired shape of a median barrier for highway construction, and having spaced apart openings in the top of the shell member, the shell member being adapted to be arranged end-to-end with other shell members on a road subsurface to define an interior space beneath the shell members for receiving filler material which does not adhere to the polymer concrete shell members.

In another aspect, the invention consists of a highway median barrier construction on a road surface or bridge structure, comprising:

(a) a series of elongated, relatively thin outer U-shaped shell members placed in end-to-end arrangement along the road or bridge surface, each shell member being integrally pre-formed of polymer concrete, having an outer surface corresponding to the desired shape of the median barrier, and having spaced apart openings along the top of the shell members, the shell members defining an interior space beneath;

(b) an inner core in the interior space consisting of solid filler material which does not adhere to the inner surface of the shell members, but contacts at least the inner side surfaces thereof;

(c) polymer concrete sealing the openings in the top of the shell members; and (d) means securing the barrier construction to the road surface or bridge structure.

In still another aspect, the present invention consists of a method of forming a median barrier construction, which comprises:

(a) securing a series of elongated U-shaped shell members in end-to-end arrangement for a desired distance along a road subsurface or bridge structure at appropriate positions to separate traffic lanes, each of said U-shaped shell members being integrally pre-formed of polymer concrete and having an outer surface defining the desired shape of the median barrier, and having spaced apart openings along the top thereof to define an interior space beneath the shell members;

(b) casting a material into the interior space through said openings, said material contacting at least the inner side surfaces of the shell members but not adhering thereto; and (c) sealing the openings with polymer concrete.

Figure 1:
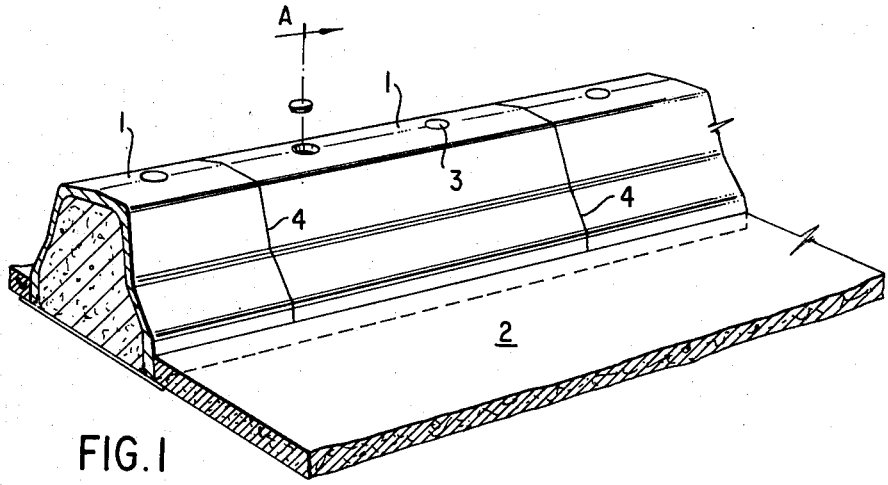
FIG. 1 is a perspective view showing a general arrangement of a construction according to the invention used as a median barrier on a dual highway.
Figure 2:
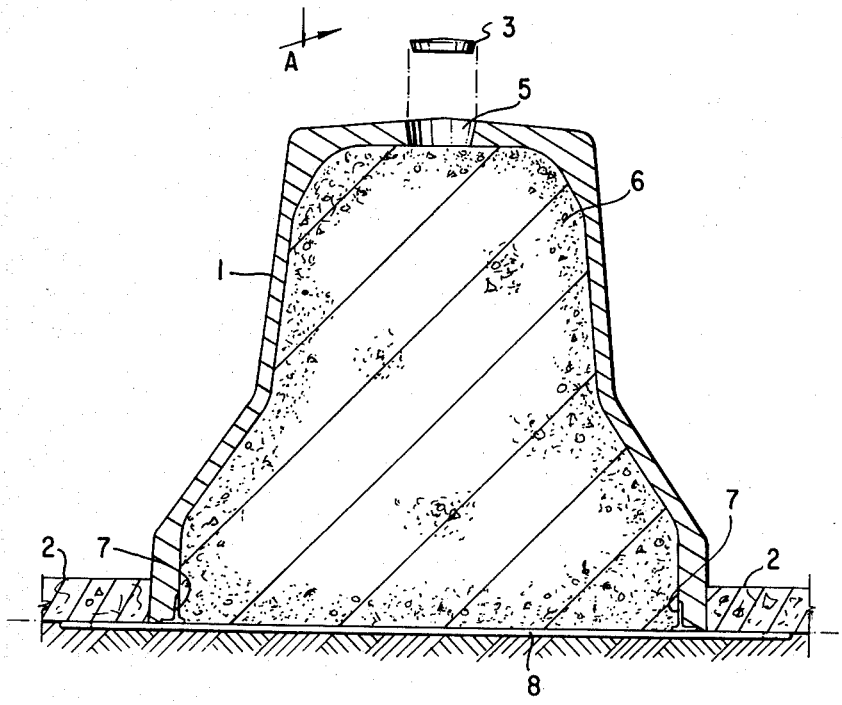
FIG. 2 is a partly exploded view in cross-section of the median barrier along the line A—A of FIG. 1.

Referring to the drawings in detail, 1 represents a pre-cast polymer concrete shell member, the members being placed in end-to-end arrangement as shown in FIG. 1. FIGS. 1 and 2 show the positioning of the shell relative to the asphalt surface 2 of the road. Openings are provided at intervals along the top of the shell members, as indicated by 5, and these openings are capped or plugged with polymer concrete 3, after the interior of the shell has been filled with ballast material 6. The shell members are placed in end-to-end arrangement as indicated in FIG. 1, and compressible gasket material 4 can be placed therebetween. In the particular embodiment shown in the drawings, cast-in anchors 7 are shown for securing the shell, e.g. by welding, to bars 8 at the construction site, and the whole is then positioned on the road subsurface. The bars and anchors are situated at intervals along the length of the shell members.

The median barrier may be of any particular desired outer configuration, but as a general designation the term "U-shaped shell member" is used herein to emphasize that according to the invention the shell members are integrally formed in the overall shape of the median barrier. A variation worth mention is that the legs of the U may be of different lengths if the median barrier is to be erected where adjacent road surfaces are not at the same level.

As already indicated, the U-shaped shell members according to the present invention are pre-cast of polymer concrete, or "PC" as it is known in the art. Polymer concrete consists of conventional aggregates and fillers as required for hydraulic concrete, but which are mixed with polymer and/or monomer as binder, as for example an unsaturated polyester resin dissolved in sytrene or other monomer. The binder is mixed with the aggregates and fillers in mixing equipment, placed in a mould, vibrated and cured in place by inclusion of appropriate initiators and cross-linking agents in the mix, and/or by the use of heat. Other methods which may be employed are injection or impregnation techniques for adding the liquid binder to dry aggregate mix.

Conventional hydraulic concrete is not suitable for casting on any large scale in thin vertical moulds. By contrast, the properties of polymer concrete are such that it can be used in vertical casting of thin sections, as for example ¾"–2", and utilized according to the present invention to integrally cast the shell members in an overall "U" shape, without cracking of the shell members on removal from the moulds, shipping, or erection at the construction site. The reason that polymer concrete mix can be cast into a vertical mould successfully with ensured quality of the final product is that the quality of the concrete is not dependent on the amount of liquid added, as with hydraulic concrete, where it must be kept to a minimum. In fact, the viscosity of the concrete mix for polymer concrete can be adjusted at will by, for example, the use of heat or the fact that the binder materials may be of inherently very low viscosity anyway. In other words, the mix for polymer concrete is readily pourable into a mould to form a U-shaped shell which can be quite thin, and reproducible quality of the shell can readily be maintained.

As indicated already, the U-shaped shell members are cast with spaced apart holes in the top, which are for filling of the shell when it is secured in place on the highway subsurface. These holes can readily be formed by dummy caps or plugs placed in the mould, or the polymer concrete section can be cast completely as one piece and the caps or plugs later cut out using special cutting equipment. If the former, the caps or plugs can be separately moulded to the correct size. Another method is, when the shell is in position and has been filled with the ballast material, to seal the openings with cast-in-place polymer concrete mortar material.

The U-shaped shell sections can also be provided with other spaced apart openings in the top as may be required for attachment of securing means, securing of light standards thereto, and passage of electrical conduits therefrom.

Pre-cast polymer concrete is noted for high strength characteristics, and it has been found in casting the U-shaped shells according to the present invention that reinforcing material is not critical, but when used such reinforcing means as steel mesh or glass fibre, for example, can be placed in the mould.

Various anchoring means can be cast in the lower ends of the U-shaped shell sections as a means of securing the shell sections in position on the road subsurface. An example is the anchor and bar structure shown in the drawings, and as already described. This means secures the shell member to the road subsurface in the sense that it prevents "floating" of the shell when it is filled with ballast. The word "securing" is to be understood to include this meaning when used herein. An alternative is bolt means cast in the shell ends and extending therefrom which can be secured by plate and bolt means to, for example, a bridge structure. Another example is steel plates secured in the road surfacing in spaced apart relationship so that when the shell sections are placed therebetween, lateral shifting is prevented. The shell sections may also be placed over existing concrete or other barrier structures, and then provision can be made for securing the shell sections, for example through the top of the shell sections, to reinforcing steel bars in the existing structure. Obviously, a variety of securing means may be used, but as such are not a critical feature of the invention.

The polymer concrete shells can be white in colour for visibility purposes by the addition of appropriate pigments, as for example titanium dioxide, to the aggregate and filler mix used to make the concrete. Because of the known very high resistance of polymer concrete to chemicals, a median barrier having an outer shell of polymer concerete will retain its colour and will not be affected by moisture and salt used on highways in many areas in winter. Because of its impermeability, the polymer concrete will remain clean. It is not porous, as is conventional concrete, and thus dirt cannot penetrate into it and remain lodged therein.

The polymer concrete shell members according to the invention are suitably cast in lengths of about 20 feet, and in a thickness of about 1 inch, varying to perhaps 1½ inches towards the bottom and top of the shell for reinforcing purposes.

The shell members are placed end-to-end, and, as has been indicated, compressible gasket material can be placed therebetween if desired, or the members merely placed end-to-end and an efficient seal obtained mostly by compressive forces.

Although not shown in the drawings, the end members of a highly median barrier can be cast in special moulds to form a tapered structure for safety purposes. Alternatively, a vertical end piece can be cast in special moulds at one end of each terminal section. Another possibility is that no special end construction is provided, but rather the core material left exposed at each end of the complete length of the median barrier.

If the median barrier shell structure is being erected during construction of a new road, it is placed in position on the road subsurface prior to asphalt surface being applied. When the median barrier is in place and asphalt layer applied to the road, it will extend a distance above the lower edges of the shell sections along the sides. This will of course be taken into account in molding of the shell sections, in view of the desired height of the median barrier above the final road surface. When the median barrier shells are erected on an existing road surface, the asphalt layer is removed as required and then re-applied adjacent the shell sections when the barrier structure is completed.

As to the ballast material which is used to fill the inner space beneath the shell members, any material can be used which will provide the required impact resistance. This material must at least contact the sides of the shell, as if there is any space between the sides of the shell and the fill the proper impact resistance is not obtained. However, according to the present invention the ballast material does not adhere to the polymer concrete shell, which provides several advantages. These are that if differential expansion and contraction of the shell and the core material occurs, it will not result in cracking of the shell because of the fact that the two materials do not adhere.

Thus, the ballast material can be gravel, sand or earth fill, or preferably it is cast-in-place hydraulic concrete. Portland cement concrete when cast in place into a pre-formed shell of polymer concrete does not adhere to the latter. There is no chance of course that this concrete fill, once formed, can be dislocated to leave any substantial space between it and the sides of the shell, and thus it is the preferred ballast material. However, as the fill is generally completely protected by the structure of the shell, the hydraulic concrete need not be of high quality, and a compressive strength of 2,500 p.s.i. or even lower is acceptable.

As indicated already, however, the median shell sections may be put in place over an existing concrete or steel barrier or other structure, suitably reduced in size if necessary, and when this is the case the space between the shell sections and the existing structure is then filled with the ballast as described.

The structure and method according to the invention, it is evident from the foregoing, have a number of advantages as to price and simplicity of method of assembly at the construction site.

The embodiments of the invention in which an exclusive property or privilege is claimed are defined as follows:

1. A structural member comprising an elongated, relatively thin outer U-shaped shell member open at one end between the legs thereof integrally pre-formed of polymer concrete, and having an outer surface defining a desired outer peripheral shape of a median barrier for highway construction, and having spaced apart openings in the top of the shell member, the shell member being adapted for end-to-end arrangement with other shell members along a road subsurface to form an interior space therebeneath for receiving filler material which does not adhere to the polymer concrete shell members.

2. The structural member according to claim 1, wherein separately moulded, pre-formed polymer concrete caps are supplied which fit into and are adapted to seal the openings in the top of the shell member.

3. The structural member according to claim 1, wherein the pre-formed shell member incorporates reinforcing means.

4. A highway median barrier construction on a road surface or bridge structure, comprising:

(a) a series of elongated, relatively thin outer U-shaped shell members open at one end between the legs thereof placed in end-to-end arrangement along the road or bridge surface, each shell member being integrally pre-formed of polymer concrete, and having an outer surface corresponding to the desired peripheral shape of the median barrier, and having spaced apart openings in the top of the shell, the shell members defining an interior space therebeneath;

(b) an inner core in the interior space consisting of solid filler material which does not adhere to the inner surface of the shell members, but contacts at least the inner side surfaces thereof;

(c) polymer concrete sealing the openings in the top of the shell members; and (d) means securing the barrier construction to the road surface or bridge structure.

5. The construction according to claim 4, wherein the shell members in end-to-end arrangement are separated by compressible gasket means, adhered to the ends thereof.

6. The highway median barrier construction according to claim 4, wherein the inner core consists of cast-in-place hydraulic concrete.

7. The highway median barrier construction according to claim 4, wherein the polymer concrete sealing the openings in the top of the shell members consists of separately pre-formed plugs or caps.

8. The highway median barrier construction according to claim 4, wherein the polymer concrete sealing the openings in the top of the shell members consists of cast-in-place polymer concrete.

9. The method of forming a median barrier construction which comprises:

(a) securing a series of elongated U-shaped shell members open at one end between the legs thereof in end-to-end arrangement for a desired distance along a road subsurface or bridge structure at appropriate positions to separate traffic lanes, each of said U-shaped shell members being integrally pre-formed of polymer concrete, and having an outer surface defining the desired outer peripheral shape of the median barrier, and having spaced apart openings in the top thereof, to define an interior space beneath said shell members;

(b) casting a material into the interior space through said openings, said material contacting at least the inner side surfaces of the shell members but not adhering thereto; and (c) sealing the openings with polymer concrete.

10. The method according to claim 9, wherein the filler material is cast-in-place hydraulic concrete.

11. The method according to claim 9, wherein the openings are sealed with polymer concrete plugs separately pre-cast.

12. The method according to claim 9, wherein the openings are sealed with cast-in-place polymer concrete.

* * * * *